US005294326A

United States Patent [19]

Shahin

[11] Patent Number: 5,294,326

[45] Date of Patent: Mar. 15, 1994

[54] FUNCTIONAL PLATING FROM SOLUTIONS CONTAINING TRIVALENT CHROMIUM ION

[75] Inventor: George E. Shahin, Clinton, N.J.

[73] Assignee: Elf Atochem North America, Inc., Philadelphia, Pa.

[21] Appl. No.: 960,564

[22] Filed: Oct. 13, 1992

Related U.S. Application Data

[63] Continuation of Ser. No. 815,108, Dec. 30, 1991, abandoned.

[51] Int. Cl.[5] ..... C25D 3/06; C25D 3/56

[52] U.S. Cl. ..... 205/287; 205/290; 205/243; 106/1.25

[58] Field of Search ..... 205/287, 290, 243; 106/1.25

[56] References Cited

U.S. PATENT DOCUMENTS

| | | | |
|---|---|---|---|
| 3,954,574 | 5/1976 | Gyllenspetz et al. | 205/287 |
| 4,054,494 | 10/1977 | Gyllenspetz et al. | 205/287 |
| 4,062,737 | 12/1977 | Barclay et al. | 205/243 |
| 4,093,521 | 6/1978 | Renton et al. | 204/43 R |
| 4,278,512 | 7/1981 | Barclay et al. | 205/285 |
| 4,612,091 | 9/1986 | Benaben et al. | 205/285 |

*Primary Examiner*—John Niebling
*Assistant Examiner*—Kishor Mayekar
*Attorney, Agent, or Firm*—Stanley A. Marcus; Robert B. Henn

[57] ABSTRACT

Functional chromium and chromium-alloy deposits are obtained from an electroplating solution having substantially the composition: 22 g/l $Cr^{+3}$; 250 g/l KCl; 63 g/l $H_3BO_3$; 30 g/l $HCO_2^{=}$; 15 g/lKBr; and 120 ppm of a wetting agent. The plating solution provides improved efficiency, stress values and appearance over the prior art, and is tolerant of metallic iron and ionic iron and ammonium.

13 Claims, No Drawings

FUNCTIONAL PLATING FROM SOLUTIONS CONTAINING TRIVALENT CHROMIUM ION

CROSS-REFERENCE TO RELATED APPLICATION

This application is a continuation of co-pending U.S. patent application Ser. No. 07/815,108, filed Dec. 30, 1991.

BACKGROUND OF THE INVENTION

1. Field of the Invention

This invention is in the field of chromium electroplating. More particularly, the present invention is in the field of plating functional chromium and chromium alloys from a solution containing trivalent chromium where the solution contains minimal ammonium ion.

2. Description of the Prior Art

Chromium is traditionally electroplated from electrolytes containing hexavalent chromium, but many attempts over the last fifty years have been made to develop a commercially acceptable process for electroplating chromium using electrolytes containing only trivalent chromium ions. The incentive to use electrolytes containing trivalent chromium salts arises because hexavalent chromium presents serious health and environmental hazards; hexavalent chromium ion and solutions from which it can be plated have technical limitations including the ever-increasing cost of disposing of plating baths and rinse water. Further, the operation of plating from baths containing substantially hexavalent chromium ion has operational limits which increase the probability of producing commercially unacceptable deposits.

The problems associated with electroplating chromium from solutions containing trivalent chromium ions are primarily concerned with reactions at both the anode and cathode, plating rate, hardness, and thickness of the ultimate coating. Other factors which are important for commercial processes are the material, equipment and operational costs.

In order to achieve a commercial process, the precipitation of chromium hydroxy species at the cathode surface must be minimized to the extend that there is a sufficient supply of dissolved, i.e., solution-free, chromium (III) complexes at the plating surface, and that the reduction of chromium ions is promoted.

U.S. Pat. No. 4,062,737 describes a trivalent chromium electroplating process in which the electrolyte comprises aquo chromium (III) thiocyanate complexes. The thiocyanate ligand stabilizes the chromium ions, inhibiting the formation of precipitated chromium (III) salts at the cathode surface during plating, and also promotes the reduction of chromium (III) ions. United Kingdom patent specification No. 1,591,051 describes an electrolyte comprising chromium thiocyanate complexes in which the source of chromium is a cheap and readily available chromium (III) salt such as chromium sulfate.

Improvements in performance, i.e., efficiency or plating rate, plating range and temperature range, have been achieved by the addition of a complexant which provides one of the ligands for the chromium thiocyanate complex. These complexants, described in U.S. Pat. No. 4,161,431, comprise amino acids such as glycine and aspartic acid, formates, acetates or hypophosphites. As described in that publication, the improvement in performance depends on the ligand used.

The complexant ligand is effective at the cathode surface, to inhibit further the formation of precipitated chromium (III) species. It is noted in that patent that the improvement in performance permitted a substantial reduction in the concentration of chromium ions in the electrolyte, without the process ceasing to be commercially viable.

In U.S. Pat. No. 4,278,512, practical electrolytes comprising chromium thiocyanate complexes are described; these electrolytes contain less than 30 millimoles of chromium, the thiocyanate and complexant being reduced in proportion. The reduction in chromium concentration has several desirable effects. Initially, the treatment of rinse waters is simplified; secondly, the color of the chromium deposit is reportedly significantly lighter.

Oxidation of chromium and other constituents of the electrolyte at the anode are known to inhibit plating progressively and rapidly. Additionally, some electrolytes result in anodic evolution of toxic gases. An electroplating bath having an anolyte separated from a catholyte by a perfluorinated cation-exchange membrane, described in United Kingdom patent specification No. 1,602,404, successfully overcomes these problems. Alternatively, an additive, which undergoes oxidation at the anode in preference to chromium or other constituents, can be made to the electrolyte. While a suitable additive is described in U.S. Pat. No. 4,256,548, one clear disadvantage of using a consumable additive is the ongoing expense.

In U.S. Pat. No. 4,612,091, Benaben et al. show the use of trivalent chromium ion in a solution with low pH where the thickness of the plate approaches functional values. The chromium ion is obtained by reduction of chromium trioxide.

SUMMARY OF THE INVENTION

The present invention is the improvement in a solution containing trivalent chromium ion for functional electroplating of chromium and chromium alloys, and being effective at low or zero ammonium-ion content, which solution is nevertheless capable of efficient operation with contaminating amounts of metallic iron, and iron and ammonium ion, present.

DESCRIPTION OF THE PREFERRED EMBODIMENTS

The preferred embodiment of the present invention is the improvement in a trivalent chromium electroplating bath which comprises substantially zero ammonium ion and iron, which bath is, however, capable of tolerating contamination by those moieties without loss of effectiveness.

The most-preferred embodiment of the present invention is an aqueous solution having substantially the following composition, where concentrations are given in grams per liter (g/l) of the solution, except for the surfactant, or wetting agent, noted as parts per million (ppm): $Cr^{+3}$, 22; KCl, 250; $H_3BO_3$, 63; $HCO_2^{=}$, 30; KBr, 15; wetting agent, 120 ppm. The wetting agent used in the discussion herein is an ethoxylated diamine; however, it has been determined that the exact nature of the surfactant is not critical to the performance of the bath of the present invention. Chromium plate of functional thickness is obtained from the baths of this invention. As used herein, the terms "bath" and "solution" are interchangeable. The solutions described in the present specification are generally aqueous. In a specific example of the utility of the present invention, several determinations were made of the ability to plate relatively thick, hard coatings onto basis metal. A comparison of baths of the prior art and that of the present invention is given hereinbelow.

Effect of Variations in Ammonium and Iron Concentrations on Plate Parameters

| Ingredient | Sample No. | | |
|---|---|---|---|
| g/l | 1 | 2 | 3 |
| $Cr^3$ | 20–25 | 20–25 | 20–25 |
| KCl | 110 | 110 | 250 |
| $NH_4Cl$ | 98 | 98 | 0 |
| $H_3BO_3$(1) | 54 | 63 | 63 |
| Acetate | 2–10 | 0 | 0 |
| Formate(2) | 30 | 30 | 30 |
| $Fe^{+2}$ or $+3$ | 100 ppm | 100 ppm | nil |
| $NH_4Br$ | 10 | 10 | nil |
| KBr | 0 | 0 | 15 |
| Surfactant(3) | 120 ppm | 120 ppm | 120 ppm |

Notes:
(1)Boric acid can be present up to its solubility limit in the bath.
(2)The formate ion can be present as the potassium ion, ammonium ion or any other ion suitable for maintaining pH at any appropriate level above 1.5.
(3)The surfactant can be any wetting agent whose structure is not susceptible of attack by the bath chemistry.

The chromium plate on basis-metal parts plated from the bath described as Sample 1 was of the order of 0.0013 millimeters (mm); that plate had poor cohesion, strength and appearance. Plating onto parts from Sample 2 was uneconomically slow, but produced a chromium plating about 0.03 mm thick, with otherwise acceptable commercial characteristics. Plating onto parts from Sample 3 proceeded at about 0.03 mm of plating thickness per hour; an 0.11-mm-thick plate was hard, adhered well to the basis metal, and had good color and appearance in general. Parts plated from the bath of Sample 3 appeared visually identical with a conventional hexavalent chromium plate.

It has surprisingly been discovered that the plating efficiency obtained from the bath of the present invention is significantly greater than that obtained from a conventional trivalent plating bath in the current density region of about 8 to 12 A/dm$^2$. Specifically, where the efficiency at 7.9 A/dm$^2$ was about 14%, the efficiency of the ammonia-free bath of this invention was about 22%; and the standard bath provided about 17% at 11 A/dm$^2$, while the ammonia-free bath had a 28% efficiency.

Plating from the bath of Sample 3 produced low stress values. The stress measurement of a 0.013-mm thick plate obtained from Sample 3 at pH 2.7 and 37 degrees Centigrade (°C.) was about 670 kilograms per square centimeter (Kg/cm$^2$), while that obtained from Sample 2 was about 1230 Kg/cm$^2$ for a sample of equal thickness. As the thickness of the plate increased, the stress values of the ammonia-free bath of Sample 3 decreased until at about 0.065 mm, the stress was effectively zero, and at 0.08 mm, the stress was compressive, but almost neglibly so. In that same range of plating thicknesses, the stress values for plates obtained from Sample 2 decreased from a tensile value of 246 Kg/cm$^2$ to 0.026 mm to a compressive value of 316 Kg/cm$^2$ at 0.08 mm.

The bath of Sample 3 has not only a tolerance for contaminants, but functions well over a wide range of chromium-ion content; specifically, the range of $Cr^{+3}$ ion can be from about 5 to about 60 g/l, the preferred range being from about 15 to 30, and the most-preferred range being from about 20 to 25 g/l.

Other acceptable variations in the components of Sample 3 are from about 150 to 400 g/l for the potassium chloride, 5 to 30 g/l for the potassium bromide, 25 to 35 g/l for the formate ion, and from 75 to 250 ppm for the wetting agent. The pH of the plating bath can be from about 1.5 to about 4.0, and is preferably about 2.7. The preferred temperature is about 37° C., with a range from about 25° to about 60° C.

In contrast to hexavalent chromium-plating baths, the bath of this invention is useful in plating both chromium metal and chromium alloys onto basis metal. For instance, the bath described in Sample 3 is useful in plating chromium-carbon alloys. The inclusion of other metals for the deposited alloy would be a matter of choice of anodes or metal ion, or both.

Ammonium ion is often used in commercial plating operations as a pH control. To determine the ability of the inventive bath to tolerate extraneous additives, further experimentation on variants of the bath showed that the bath with the general formulation given in Sample 3 could have a concentration of at least 10 g/l of ammonium ion without significant loss in plating efficacy, although neither performance nor the economics under such conditions is as good as with the bath of Sample 3.

Due to the virtually unavoidable contamination of the plating bath with iron, either as the metal or the ion, both di- and trivalent iron are deliberately added to the bath to determine its tolerance to iron concentration. Analysis shows that up to about 250 ppm of iron does not deleteriously affect the throwing power of the inventive bath.

The bath of the present invention provides chromium and chromium-alloy plating on basis metal which is hard and thick enough to be useful in areas where only hexavalent chromium baths could heretofore be utilized. In the specific case of the bath shown in Sample 3, there is no determinable limit to the thickness of the chromium plate which can be achieved.

Modifications and improvements to the preferred forms of the invention disclosed and described herein may occur to those skilled in the art who come to understand the principles and precepts hereof. Accordingly, the scope of the patent to be issued hereon should not be limited solely to the embodiments of the invention set forth herein, but rather should be limited only by the advance by which the invention has promoted the art.

What is claimed is:

1. An improved solution for electroplating chromium and chromium alloy having trivalent chromium ion, formate and bromide ion, boric acid and a wetting agent, the improvement comprising the electroplating solution having from about 5 to about 60 g/l of trivalent chromium ion, from about 200 to about 300 g/l of potassium ion, from about 50 g/l saturation of boric acid, from about 30 to about 45 g/l of formate ion, from about 5 to about 30 g/l of bromide ion, and from about 75 to about 250 ppm of a wetting agent said solution being substantially free of ammonium ion.

2. The solution of claim 1 wherein the amount of trivalent chromium ion is from about 15 to about 30 g/l.

3. The solution of claim 1 wherein the amount of trivalent chromium ion is from about 20 to about 25 g/l.

4. The solution of claim 1 wherein the amount of boric acid is from about 55 g/l to saturation.

5. The solution of claim 1 wherein the amount of formate ion is from about 25 to about 35 g/l.

6. The solution of claim 1 wherein the amount of wetting agent is from about 100 to about 150 ppm.

7. The solution of claim 1 being an aqueous bath.

8. The solution of claim 1 having a pH above about 1.5.

9. The solution of claim 1 having a pH between about 1.5and 4.0.

10. An electroplating solution for plating functional chromium containing trivalent chromium ion consisting essentially of about 22 g/l of trivalent chromium ion, about 250 g/l of potassium ion, about 63 g/l of boric acid, about 30 g/l of formate ion, about 15 g/l of bromide ion, and about 120 ppm of a wetting agent said solution being substantially free of ammonium ion.

11. In an electroplating solution containing trivalent chromium ion and capable of providing a functional chromium plate in the presence of contaminating ammonium or iron moieties, or both, the improvement which comprises the electroplating solution having about 5 to about 60 g/l of trivalent chromium ion, about 200 to about 300 g/l of potassium ion, about 50 g/l to saturation of boric acid, about 30 to about 45 g/l of formate ion, about 5 to about 30 g/l of potassium ion, and about 75 to about 250 ppm of a wetting agent said solution being substantially free of ammonium ion.

12. The electroplating solution of claim 11 capable of plating a chromium alloy.

13. The electroplating solution of claim 12 wherein the chromium alloy comprises chromium and carbon.

* * * * *